US008757251B2

(12) United States Patent
Ditillo et al.

(10) Patent No.: US 8,757,251 B2
(45) Date of Patent: Jun. 24, 2014

(54) MULTI-FUNCTIONAL MACHINE ADAPTABLE FOR DRILLING, BORING AND LIFTING

(75) Inventors: Alessandro Ditillo, Cesena (IT); Stefano Massari, Cesena (IT)

(73) Assignee: Soilmec S.p.A., Cesana (FC) (IT)

( * ) Notice: Subject to any disclaimer, the term of this patent is extended or adjusted under 35 U.S.C. 154(b) by 219 days.

(21) Appl. No.: 12/974,989

(22) Filed: Dec. 21, 2010

(65) Prior Publication Data

US 2011/0147090 A1 Jun. 23, 2011

(30) Foreign Application Priority Data

Dec. 21, 2009 (IT) ..... TO2009A1004

(51) Int. Cl.
*E21B 19/00* (2006.01)
*E21B 7/02* (2006.01)

(52) U.S. Cl.
CPC ..... *E21B 7/02* (2013.01)
USPC ..... 166/75.11; 166/77.1; 173/28

(58) Field of Classification Search
CPC ..... E21B 7/02
USPC ..... 166/75.11, 77.1, 77.51, 75.14; 173/28
See application file for complete search history.

(56) References Cited

U.S. PATENT DOCUMENTS 3,109,523 A * 11/1963 Moller ..... 52/115
3,312,291 A * 4/1967 Haug ..... 173/28
4,371,046 A * 2/1983 Read ..... 175/57
7,249,629 B2 * 7/2007 Cunningham et al. ..... 166/77.1
7,637,329 B2 * 12/2009 Stoik ..... 175/57

FOREIGN PATENT DOCUMENTS

| | | |
|---|---|---|
| CN | 201180488 | 1/2009 |
| DE | 39 19 824 | 12/1990 |
| DE | 42 31 553 | 12/1993 |
| EP | 0 745 528 | 12/1996 |
| EP | 1 983 147 | 10/2008 |
| GB | 2 166 780 | 5/1986 |

* cited by examiner

*Primary Examiner* — Kenneth L Thompson
(74) *Attorney, Agent, or Firm* — Merchant & Gould P.C.

(57) ABSTRACT

A multi-function machine for drilling, boring, driving and lifting comprising a translation system (2) which supports a turret (3) motorized and provided with driving cab. A lattice tower type arm is hinged to the frame of the turret and movable between substantially raised and inclined positions. In at least a first configuration the arm is used as a lifting arm. The free upper end of the arm has a head (9) having a system of pulleys and/or transmissions for rope (10). The arm (4) can rotate with respect to the turret (3) to acquire a second configuration of mounting/transport wherein its longitudinal axis is substantially horizontally arranged and turned over toward the front. Ropes and rods are provided (14,16) for bringing the arm from the first to the second configuration and vice-versa. The arm (4) can acquire a third operating configuration wherein its longitudinal axis is substantially vertically arranged; in said third configuration the arm (4) is a guide for a digger/drill (27) sliding in a direction substantially parallel to the longitudinal axis of the arm; being also provided an actuator (8) for maneuvering the arm (4) at least in the third configuration.

11 Claims, 14 Drawing Sheets

Sec. B-B

Sec. C-C

Sec. A-A

MULTI-FUNCTIONAL MACHINE ADAPTABLE FOR DRILLING, BORING AND LIFTING

This application claims benefit of Serial No. TO2009A001004, filed 21 Dec. 2009 in Italy and which application is incorporated herein by reference. To the extent appropriate, a claim of priority is made to the above disclosed application.

BACKGROUND

The present invention relates to a multi-function machine for drilling, boring and lifting. In particular, it describes a tracked crane provided with a lattice tower arm configurable as structural element for the lifting as crane version or configurable as guiding antenna in the usage as drilling machine.

In the field of foundation machines, in particular the drilling ones, it is known the use of a tracked crane as base of the machine, wherein the arm, generally a lattice tower arm, supports an additional supporting and guiding antenna, of lattice tower or box type too, for different drilling, boring, piling devices; a machine of this type is shown in FIG. 1.

These machines are generally used for realizing drilling having limited diameter but very relevant depths (even higher than 30-40 m), converting an operating machine dedicated to the lifting into a version suitable for drilling. In this way, the cost of the investment required for the realization of the foundation works is reduced. In view of this economy, it has to be considered that the machines referred above have generally big sizes, very relevant weights and must be demounted for being transported on the road by suitable road loaders.

Typically, the arm, the ballast and the crane caterpillars are demounted from the base machine and transported separately from it. Similarly, the guiding antenna is demounted in a plurality of elements and transported separately on a respective loader too. Finally, at least three big-sized trucks or articulated-lorries are necessary for transporting one of these machines demounted.

Another issue of the above described machines lies in the high times required for their mounting, demounting to be carried out in construction site and with the help of additional service means which become necessary for carrying out these operations. The complexity of the transformation into drilling machine requires also the handling of the main ropes which, initially wounded in the crane winches, must be unrolled and let them pass in a series of pulleys provided on an antenna head and in various blocks with pitches having more than one transmission. The above described steps imply a plurality of operations which must be partially manually carried out by operators and which are physically demanding, tiring and dangerous. Finally, the addition of another guiding tower implies higher weights and costs required in the transformation and determines limited operating capacities of the crane which has to work with higher masses in relevant working radii.

SUMMARY

A purpose of the present invention is to simplify the mounting of the cranes in the version as foundation machines, for drilling and boring, in particular by increasing the versatility and usage flexibility.

Another purpose is to obtain a crane which is easy and quick to install as drilling machine in such a way as to significantly reduce the time necessary for the transformation, with the consequent reduction of managing costs.

Another purpose is to realize a machine whose mounting/demounting requires a reduced number of manual operations, of limited physical demand for the operators and of low risk degree.

Another purpose too is to realize a machine which has compacted size and a limited encumbrance once it is demounted in such a way as to permit an easy road transport.

Finally, there is the purpose of obtaining a machine having a compacted and strong structure, sure and reliable functioning and able to precisely and accurately position the guiding antenna in a vertical and/or tilted operating position.

For these and other purposes which will be better understood hereinafter, the invention proposes to realize a machine.

BRIEF DESCRIPTION OF THE DRAWINGS

It will be now described the machine according to the invention with reference to the attached drawings, which show a non limiting realization example, wherein.

DETAILED DESCRIPTION

Figure 2:
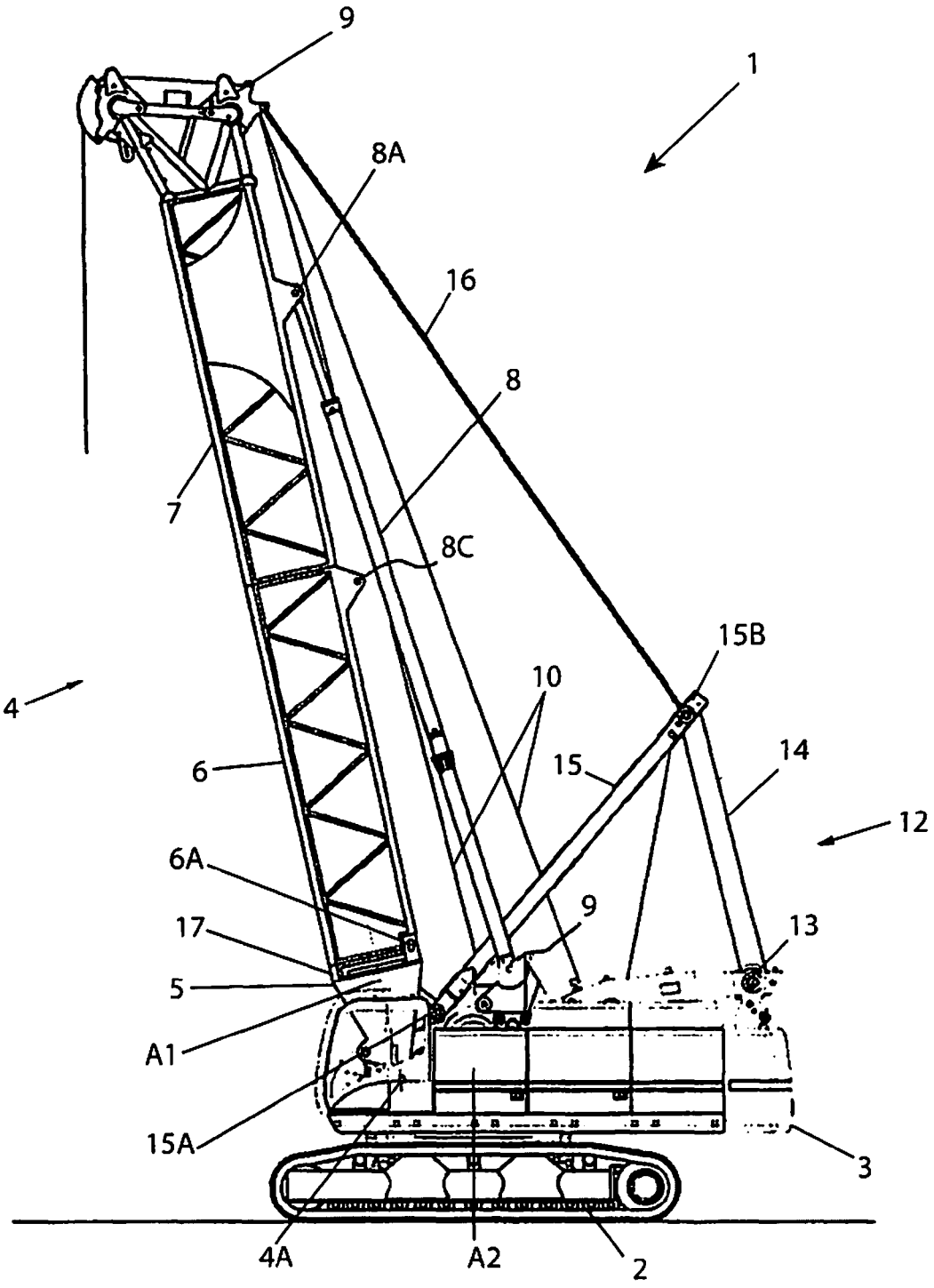
FIG. 2 is a lateral view of the machine according to the invention in an assembled condition as lifting crane.

In FIG. 2 it is shown machine 1 according to the invention in a known crane version, with a lorry 2 upon which it is mounted a rotating turret 3 which supports arm 4 directly assembled without interpositions of kinematic elements and pivoting on axis 4A. Joint 17 shown as mounted in arm 4, is of rotating disengageable type, but in this version it is lock mounted on base 5 of arm 4.

The need of arm 4 to be directly connected is for ensuring the maximum structural rigidity which would be lost in case of applications through kinematic elements.

The insertion of movable structures with pins or fifth wheels constitutes the insertion of clearances which can become dangerous when the it is used as crane.

As a matter of fact, a lifting crane must be absolutely rigid for lifting and waving very heavy workloads: it is to be considered that a "X" tons weight crane generally lifts "X" load tons. On the other hand, a piling machine can lift loads that generally do not exceed ⅕, ⅒ of the total weight of the equipment and the purpose for which they are used aims only at the obtainment of the technology, therefore for handling tools, rods, reinforcement cages, small compressors, and so on and generally with a vertical work and small forwarded load-lifting radius required for exiting from the rotary encumbrance.

For making this lifting characteristic possible and for handling objects with an elongated shape (a few tens of meters) and/or for positioning loads at high heights, cranes are realized by modular arms (extendable) with a lattice tower shape and a transversal section considerably higher than the ones of the corresponding paling machines (nearly the double).

The lattice tower element permits to relieve the loads which heavily influence the stability mainly when the arm acquires work operating conditions (lifting) with very strong tilt angles.

The angle of the arm can vary from a substantially almost vertical configuration (nearly 80° on the horizontal line) to values very near to the horizontal line (nearly 15°-20°). When the arm is horizontally loaded (with minimum angles between 15° and 20°) the values of the overturning moment generated by the suspended load and by the own weights of the arm, would be very high if this arm were heavy, at the expense then of the real loading capacity. For this reason, even if a paling antenna can pass through a configuration tilted toward the front to enter the transport condition, it cannot be used for the lifting. The lower part of arm 6 is connected to joint 17 on hinge 6A and remains fixed locking between them the parts in a movable manner with suitable connections (for instance of screw or thrust type) here not shown. Joint 17 could be also installed when the version for the foundation machine is assembled; as a matter of fact, it is not essential for the use as crane version (in fact it is locked) but if available (i.e. mounted on arm 4 and locked in rigid position for the above mentioned reasons) the conversion step can be advantageously simplified.

The central part of arm 7 is rigidly connected to lower part 6 (generally through pins and/or bolts) and connects itself to the frame of turret 3 with two telescopic rafters 8 put side by side through hinge 8A on the arm and 8B on the turret and in this configuration of lifting machine they act as bumpers.

A head 9 is connected to the top of arm 7, where there is a system of pulleys with transmissions for maneuvering ropes 10. Actuating means 12 of arm 4 are known art and comprise respective motor means 13 adapted to handle through further ropes 14 rod means 15 hinged to a first end 15A generally positioned on the frame of turret 3 or, as shown in figure, also fixed to base 5 of arm 4 and connected to the remaining second end 15B to head 9 through tie rod means 16. The arm lifting movements occur by motorizing ropes 14 which, put in traction, lower gantry 15 which rotates around 15A. This movement produces a displacement of tie rods 16 which in turn lift the whole arm, which rotates directly around the frame, around hinge 4A. The lifting of arm 4, which in all of its component elements (5; 6; 7; 21; 9) moves monolithically, brings to an increasing of the angle between the horizontal line and the direction of the axis of the arm itself (detectable with A1).

The maximum value of this angle is limited around 80° (90° would correspond to the vertical condition) and the mechanical buffers 8, provided with inner damping elements (springs or elastic devices), act as stops avoiding that the arm continues its lifting further than the predefined maximum value.

On the other hand, the descent occurs using the weight force of the arm itself or of the arm with its lifted load which create a positive moment (overturning) around hinge 4A, which is balanced by the pitch of tie rods 16 (negative balancing moment). By loosening ropes 14, the gantry raises, tie rods 16 reduce their force and the arm lowers moved by the weight force. In this case we can talk about controlled descent.

The lifting work angle is never near 90° because the soil slopes which add themselves to the ones of the arm have to be considered and there could be a combined action for which the arm could not anymore lower because the active moment of the weight forces has become negative too as the one exerted by the tie rod. The whole system would find itself locked by the buffers and the arm could not anymore lower.

Figure 3:
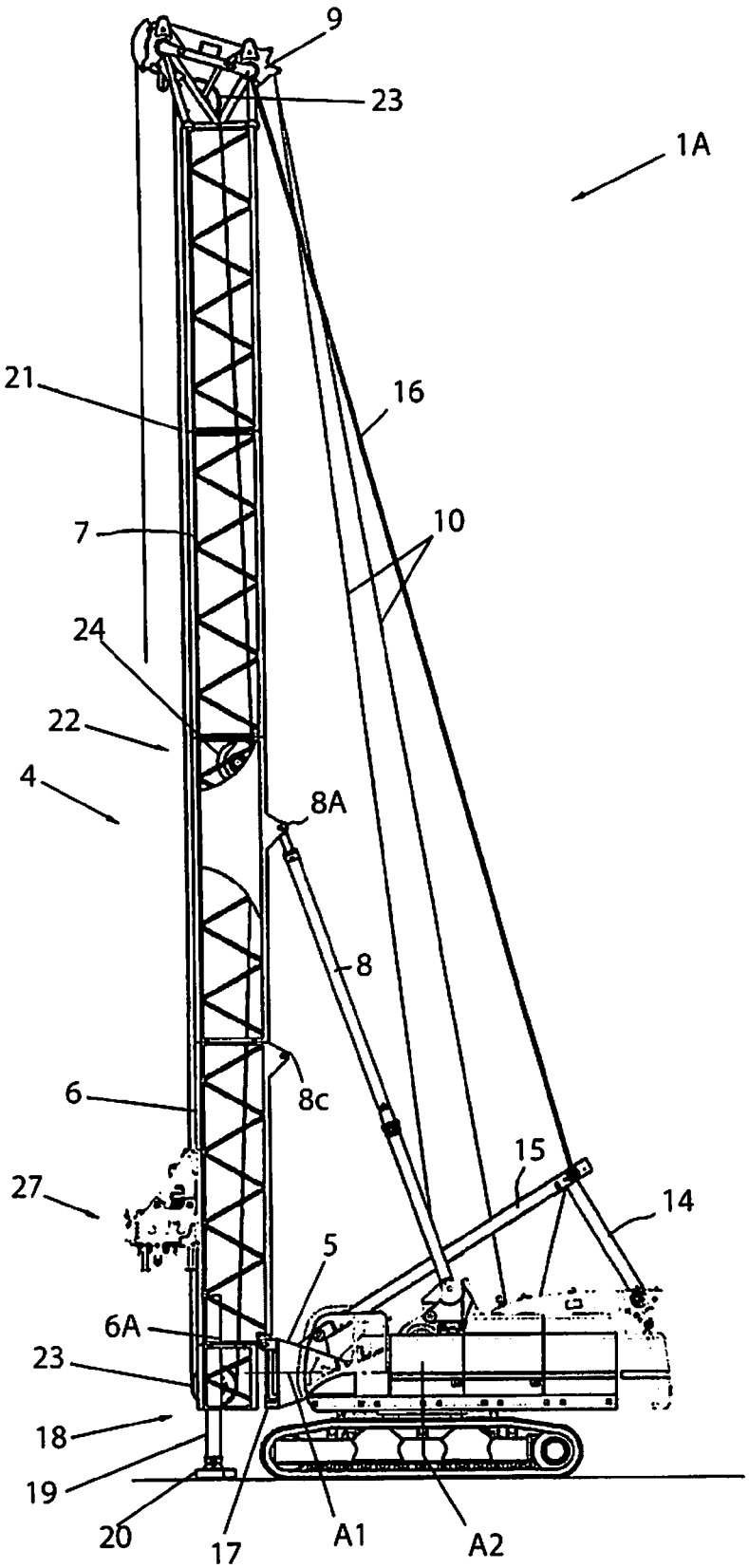
FIG. 3 is a lateral view of the machine according to the invention assembled in one of the possible conditions using it as drilling machine.

In FIG. 3 it can be noticed machine 1A according to the invention assembled in version for drilling, with base 5 of arm 6 rigidly fixed to the turret and oriented substantially perpendicular to the rotation axis of turret A2 with its own longitudinal axis A1.

The part of joint 17 assembled on base 5 of arm 6 can rotate on axis A1 through suitable motor means (linear actuators 8, preferably of hydraulic type). The lower part of arm 4 is pivotedly connected to joint 17 through hinge 6A.

The central part of arm 7 is rigidly connected to lower part 6 and connects itself to turret 3 with two telescopic rafters 8, preferably of hydraulic type, which in this machine configuration support arm 4 in a mainly perpendicular position with respect to the theoretical plane of the soil. It is possible to correct the verticality of the arm according to the real planarity of the soil upon which works the machine or it is possible to tilt it in a working position up to the reaching of the desired tilt.

In this case, unlike what has been shown for machine 1, hydraulic rafters 8 act as motor means on the lifting and lowering of the arm and tie rods 16 can follow the movement of the rafters themselves or can be moved (in case of traction) contemporarily with the rafters for increasing the lifting capacity and not losing the operating usage area as crane when one is working in very tilted conditions, with operating radii very high. A foot element 18, rigidly connected to the lower part of arm 6 and eventually constrainable (at least temporarily) also to rotating part 17*a* of joint 17, can bear a telescopic part 19 to which it is fixed a pad 20 which lies on the ground for improving the stability of the machine during the working steps.

The upper part of arm 21 is rigidly connected on central part 7 and can be in a single piece or in more parts variables among them for adapting the height of the arm to the various construction site requirements and to the typologies of the works to be carried out.

These parts are common to the crane version and are used for increasing the heights and the work operating load-lifting radii of the lifting machine. A head 9 is rigidly connected to the upper part of arm 4 where there is a system of pulleys with transmissions for maneuvering ropes 10 of the drilling tools.

A handling system 22 of operating head 27, preferably of single winding (for the lifting pitch of the drilling battery or for the thrust) or closed revolution winch type (lifting and thrust on the drilling battery) comprises upper transmission pulleys 23 mounted in proximity of head 9 and on the lower part on foot 18 upon which slide the maneuvering ropes. The lower pulleys when necessary (used for the thrust) can be positioned also on lower arm 6 and remain installed even if the machine is in crane version.

Figure 4:
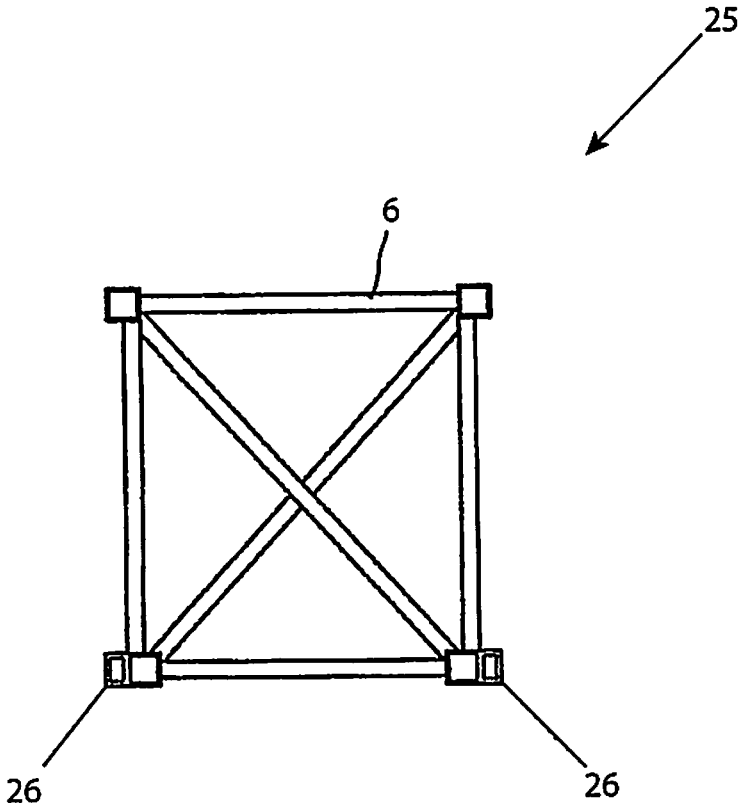
FIG. 4 is a section of a particular of the machine of the previous figures.

In FIG. 4 it is shown a not binding possible section for arm 25 which shows a typical shape of lattice tower arms of cranes with the addition of guiding elements 26 for the excavation equipment, which are integral with the existing ones (longitudinal tubular elements). These guiding tubular elements can be advantageously realized with a unique section which ensures in its mounted whole, a guide for the longitudinal movements along the axis of arm 4 and a constraint of the movements on the transversal section. In a further variant, the guide for the sliding could be realized using all the longitudinal tubular elements instead of only the front ones.

Figure 5:
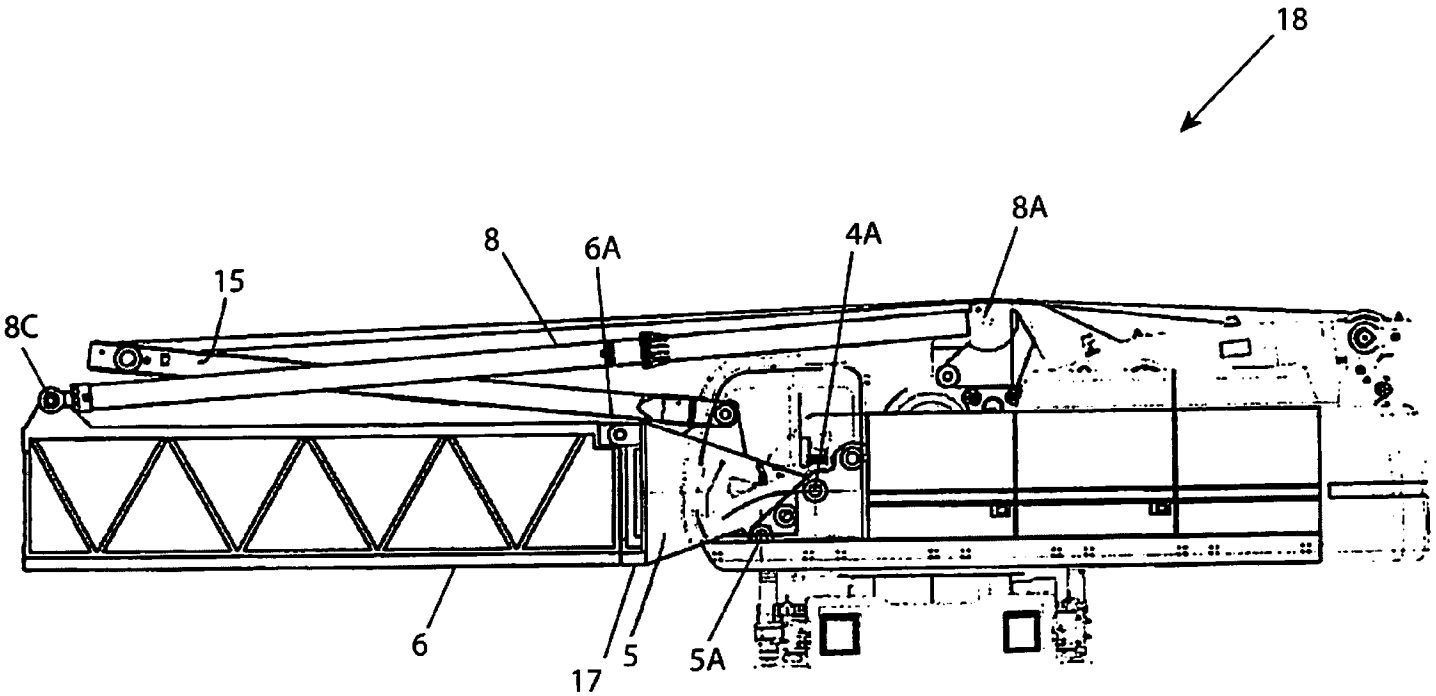
FIG. 5 shows the machine in transport condition.

In FIG. 5 it can be noticed a possible configuration of machine 1B, with the transparent cab on sight, in an assembly common to the crane or drilling machine versions adapted for being transported on a road loader.

The parts 5, 6 e 17 of arm are in a position rigidly connected among them and are directly fixed to the turret with a system of pins on hinges 4A and 5A in such a way as to prevent movements. Telescopic rafters 8 in minimum extension condition are fixed in point 8C obtained on the lower part of arm 6 avoiding to find itself in unstable or free positions during the transport.

In this way the other components which play a part in the completion of the machine in the various versions are easily transportable on the road without the need of special and/or lowered road loaders.

Figure 6:
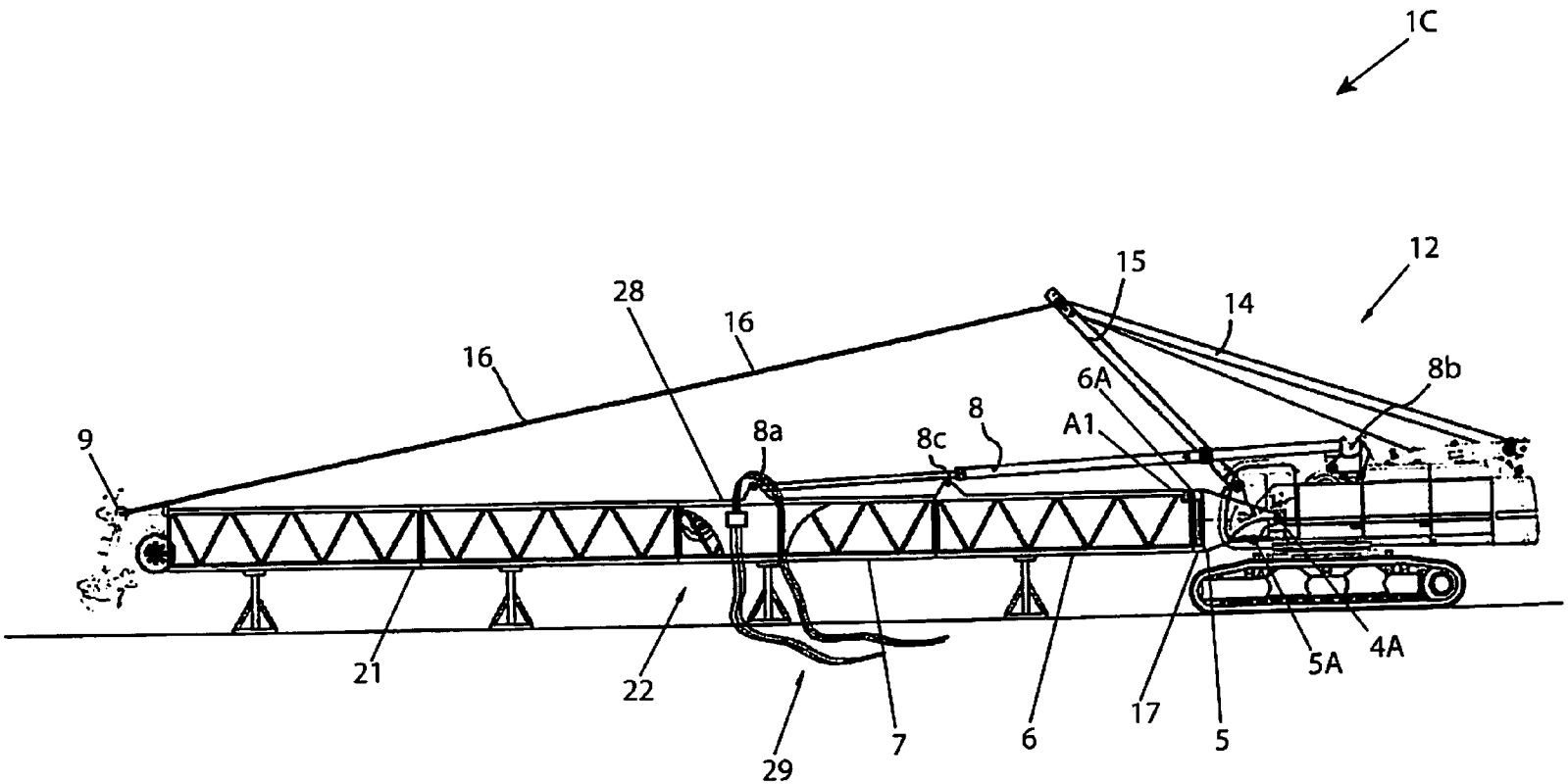
FIGS. 6 and 7 show two steps of the mounting of the machine.
Figure 7:
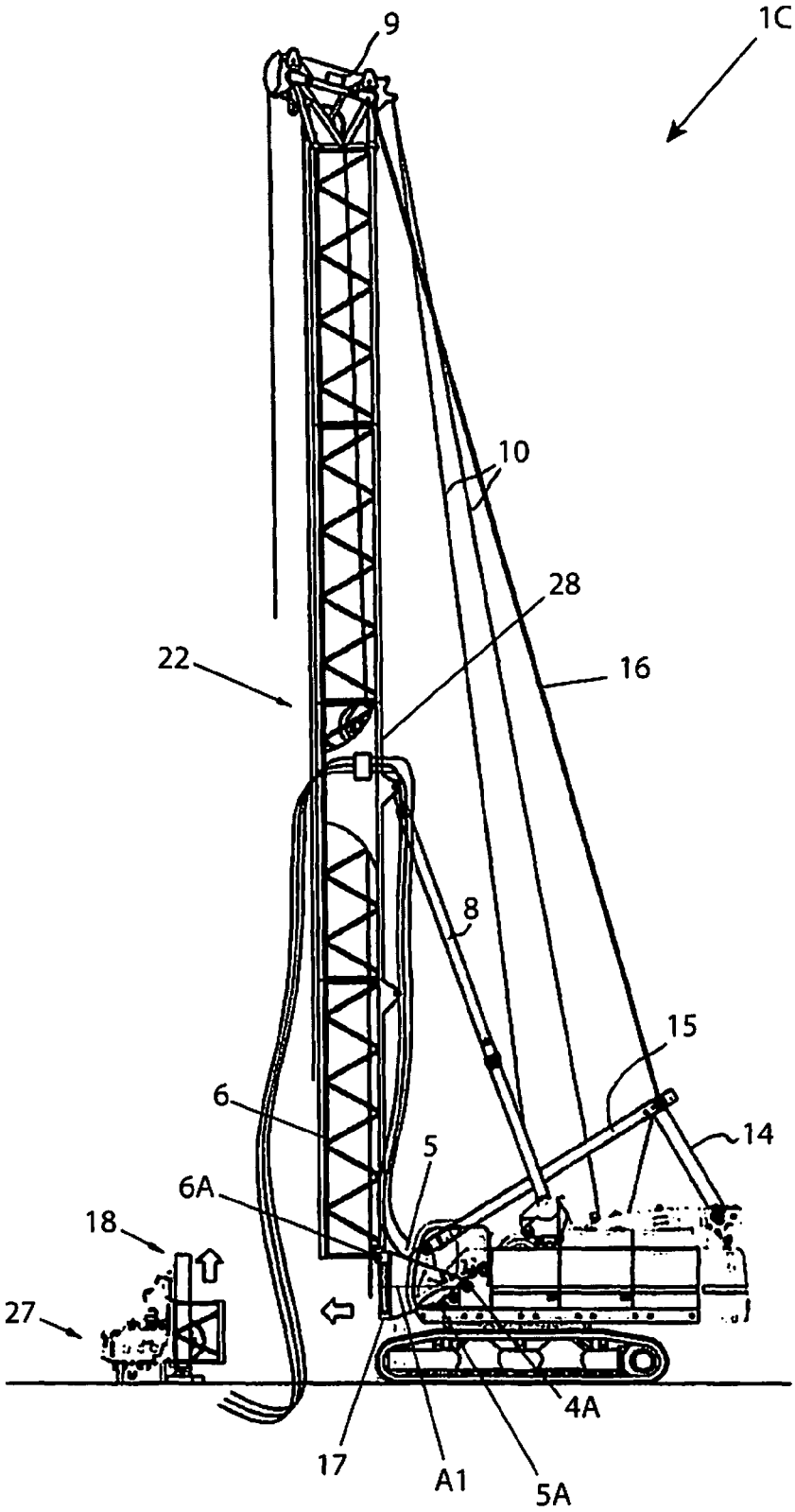

With reference to the FIGS. 5, 6 and 7 it is now described the sequence of operations needed for the installation of machine 1C arranged as drilling machine. The tracked lorry (if demountable due to the crane size) is assembled to the remaining of the machine with known working methodologies. The base of arm 5 directly connected to the turret to hinge 4A is secured in a second axis 5A permitting to keep longitudinal axis Al in a preferably horizontal position.

The central part of arm 7 is added with known fastening systems (for instance pins, screws, . . . ) and the eventual modular parts of arm 21, necessary for reaching the height of the arm necessary for the specific working requirement. Tie rod means 16 of modular type are mounted in such a way as to permit the correspondence with the length of the arm installed. Telescopic rafters 8 are fixed on hinges 8A, head 9 is added including the system of pulleys with transmissions for maneuvering ropes 10.

At this point it is assembled traction-thrust system 22 with winch including the related rope revolution. It is then mounted at preferably the half of the length of the arm, a junction element 28 for the suspension of hydraulic pipes 29 necessary for the supply and for the piloting of excavation equipment 27. Another support to the base of arm 5 for unloading the loads on the ground could be added as element additional and specific for this version or as element constantly present on base 5 itself and lowerable by means of a control preferably hydraulic.

Using actuating means 12, arm 4 is lifted, by rotating it with respect to hinge 6A, up to bring it in vertical position as shown in FIG. 7. This rotation could occur also by actuating hydraulic rafters 8 which can collaborate with means 12 for obtaining the lifting of the arm. Foot 18 with the already associated excavation equipment 27 (of the rotation type for the drilling, and/or vibration or driving sledgehammers) can be assembled to the remaining of the machine without the help of other lifting means. By positioning the machine with lower arm 6 in correspondence to the foot and after having connected the equipment (preferably of hydraulic and electrical type) it is possible to actuate telescopic handling 19 up to reach the foot bringing the two elements in contact and permitting the carrying out of the mechanical connections between foot 18 and the lower part of arm 6. A further connection, at least temporary, could be realized also with rotating part 17*a* of joint 17.

For installing the machine as crane of version 1, with reference to FIGS. 5, 6 and 2, the tracked lorry is assembled to the remaining of the machine with known working methodologies. It is freed hinge fastening point 5A in such a way as to permit arm 4 to rotate on hinge 4A. The central part of arm 7 and the eventual additional parts of arm 21 are added for reaching the height of the arm necessary for the specification of the construction site. Tie rods means 16 of modular type are mounted in such a way as to permit the correspondence with the length of the arm installed. Telescopic rafters 8 are fixed on hinge 8A, head 9 is added including the system of pulleys with transmissions for maneuvering ropes 10. Using actuating means 12, arm 4 is lifted by bringing it in working position as in FIG. 2.

The described operations are carried out at heights near to the ground, keeping the safety of the involved operators in these mounting steps.

Figure 8:
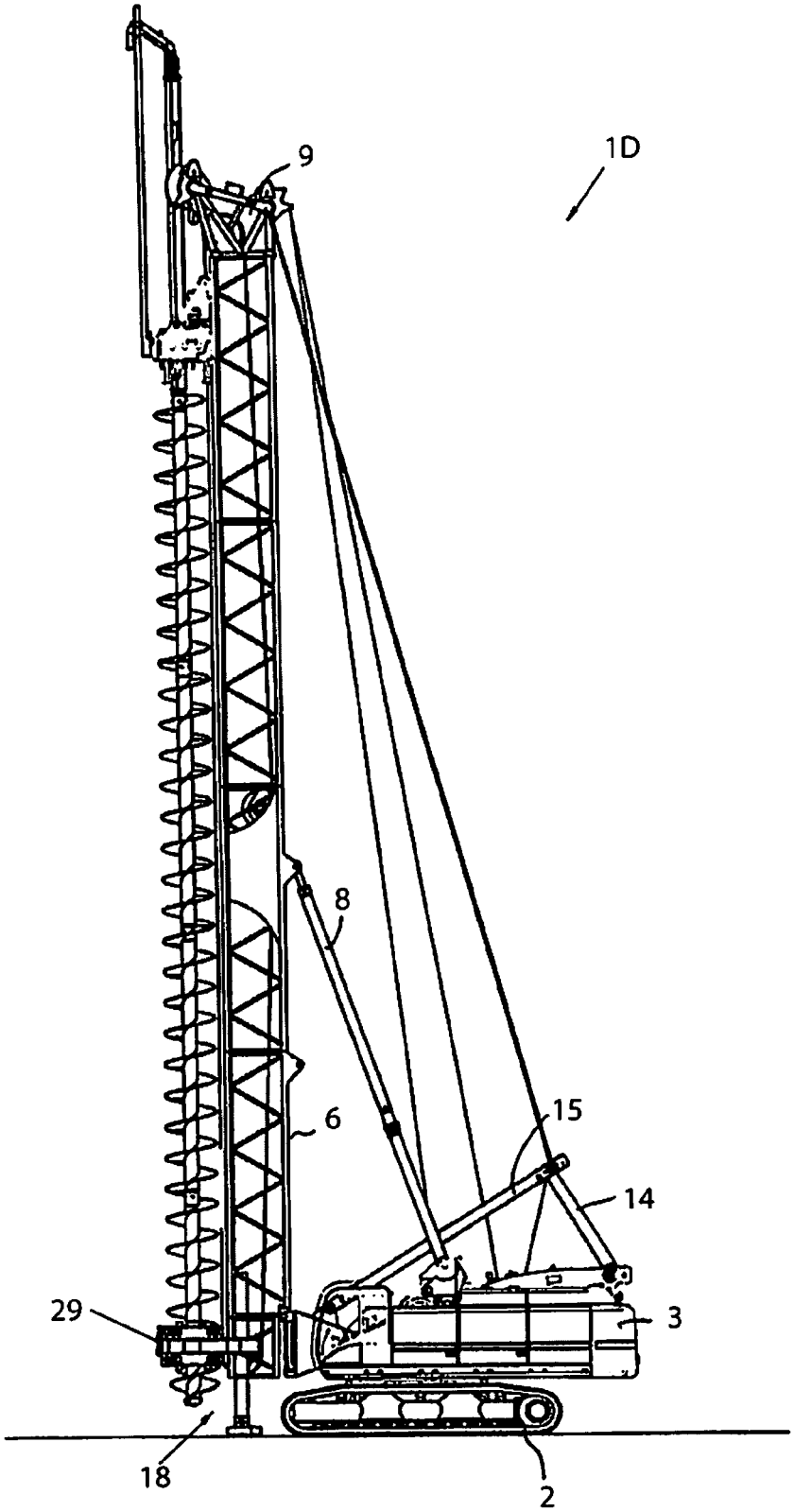
FIG. 8 shows the machine according to the invention in a condition assembled as drilling machine installed for continuous screw.

FIG. 8 shows machine 1D in operating configuration for continuous screw pile types. To foot 18 is associated an openable guide 29 typically used for this type of drilling technology but it is possible to equip the foot with other elements for carrying out other excavation types not shown, for instance a group of vices for carrying out micro-piles or with other types of guides for the carrying out of mechanical mixing treatment of soils or compaction or driving or vibro-compaction.

Figure 9:
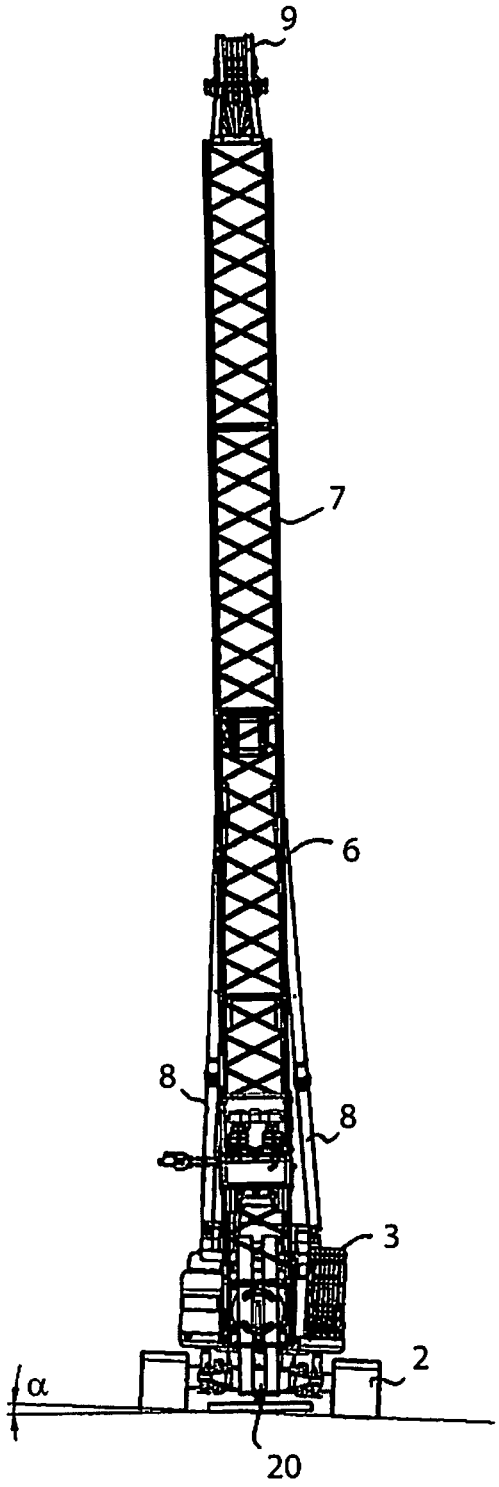
FIG. 9 shows the arm of the crane with a lateral tilt.
Figure 10:
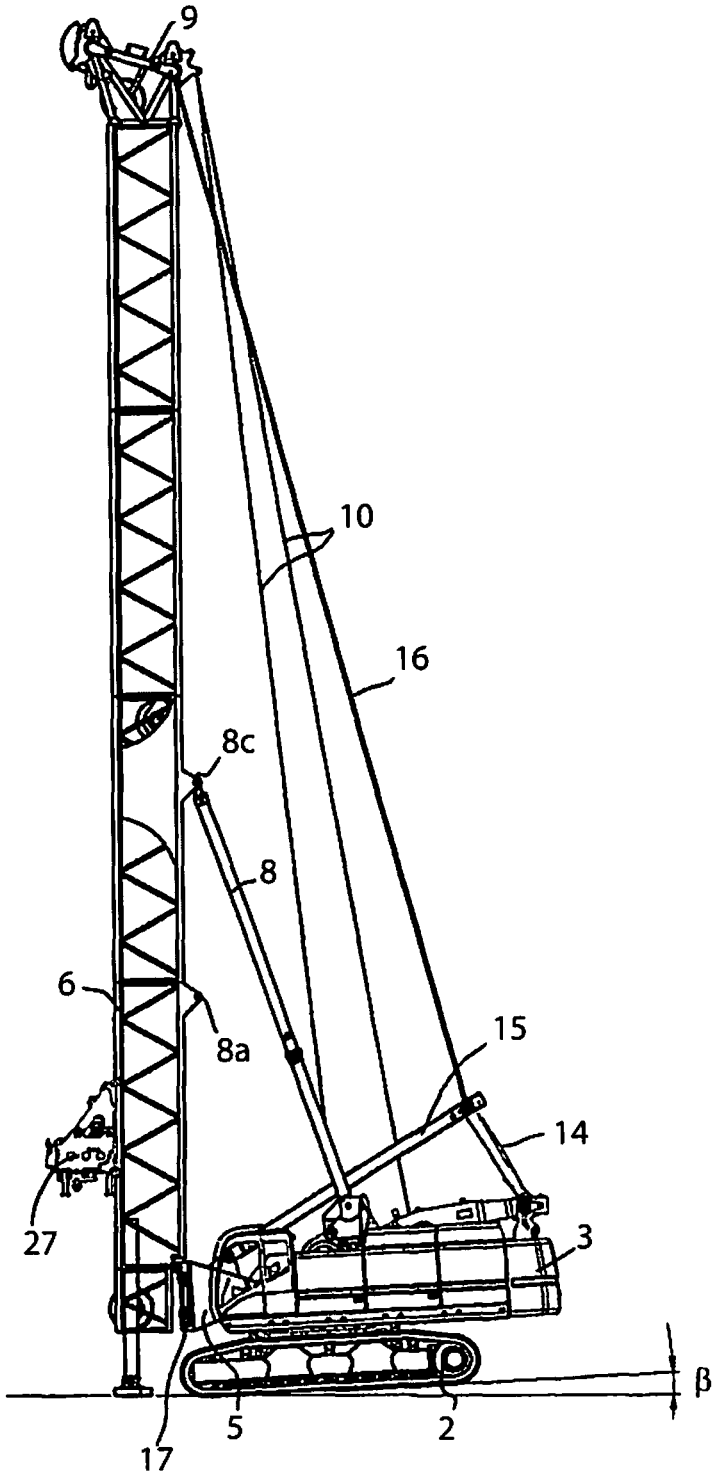
FIG. 10 shows the arm of the crane with a front tilt.

FIG. 9 shows how the arm of the crane can have a lateral tilt with a angle generated by the differential movements of the two telescopic rafters 8 (generally hydraulic), whereas FIG. 10 shows how the arm of the crane can have a front tilt with β angle by acting with synchronized closing or opening of the two telescopic rafters 8.

Figure 11B:
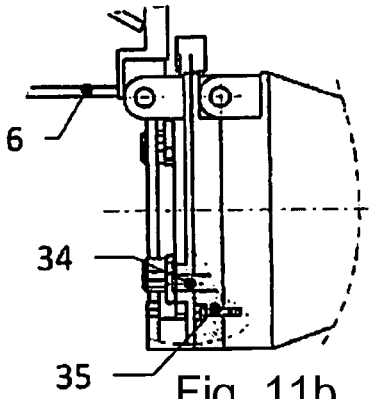
FIGS. 11, 11*a-c* show perspective views and sections of a particular of the machine according to the invention.
Figure 11:
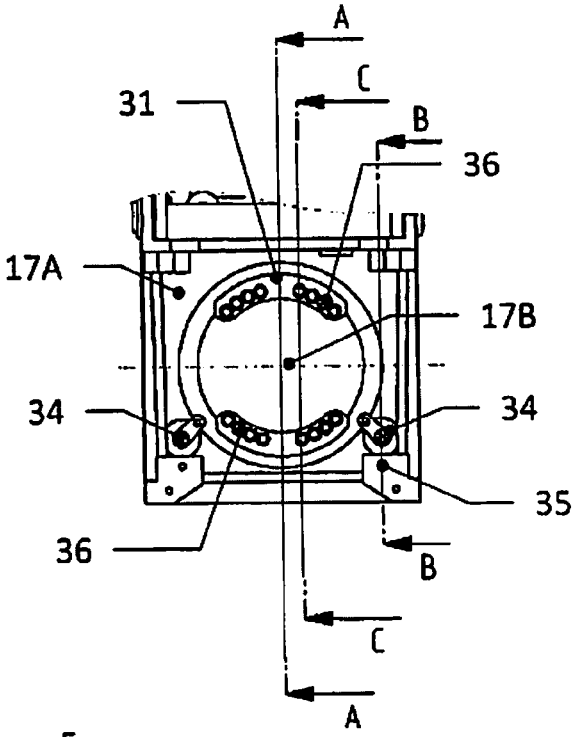
Figure 11C:
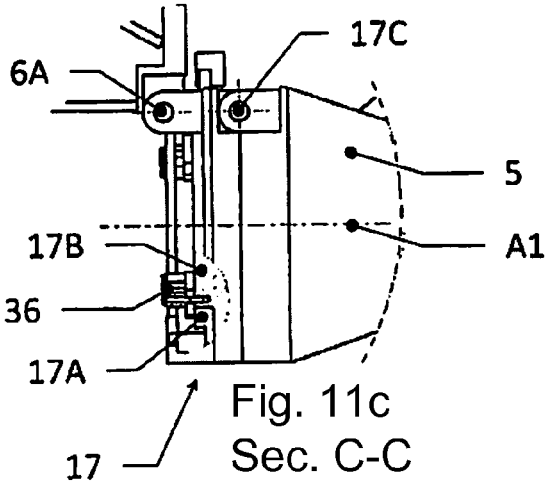
Figure 11A:
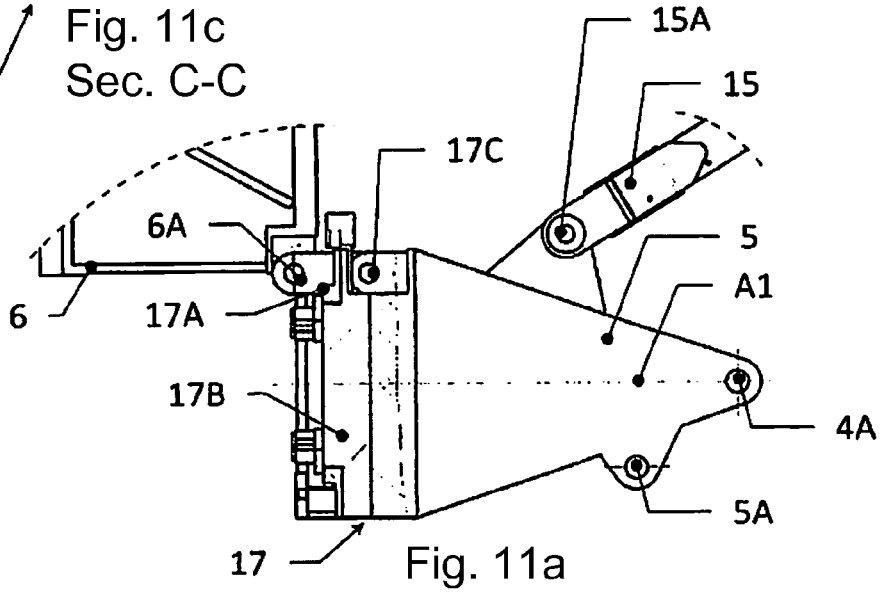
Figure 11D:
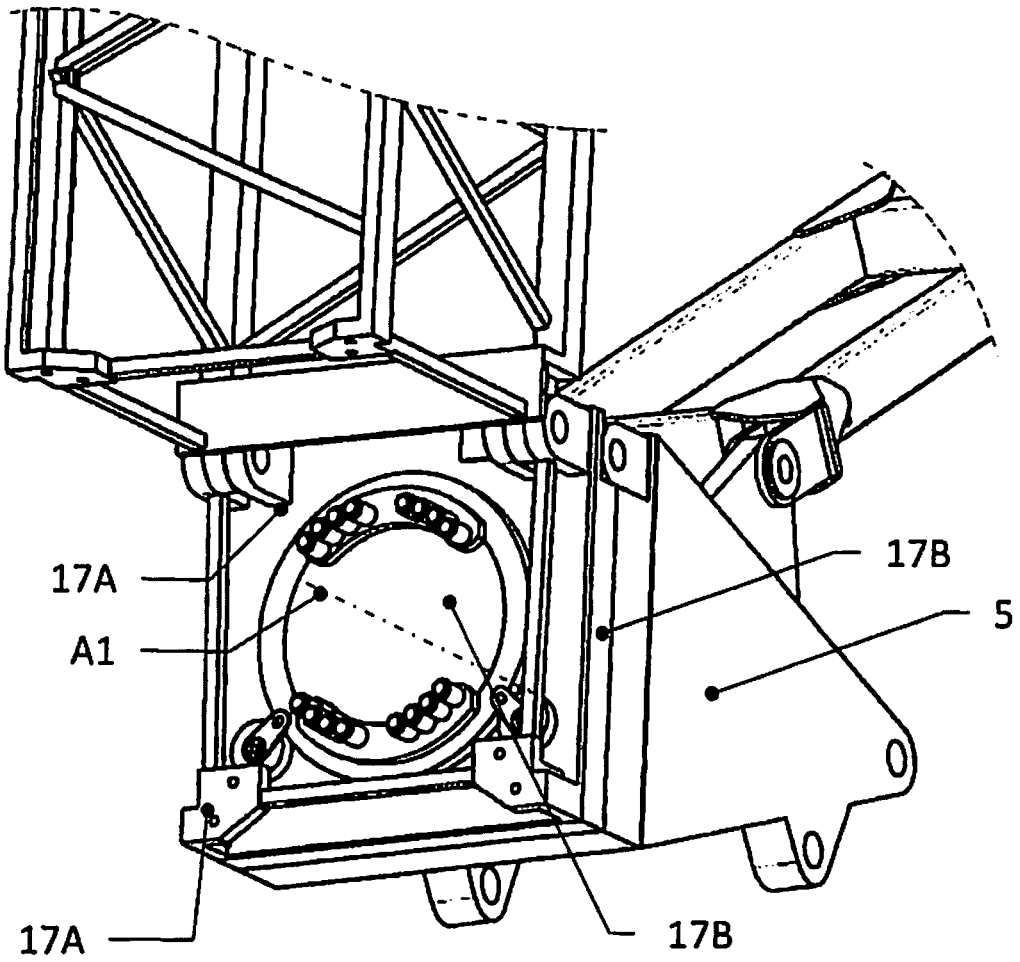
FIG. 11*d* shows a perspective view of a particular of the machine according to the invention.
Figure 11E:
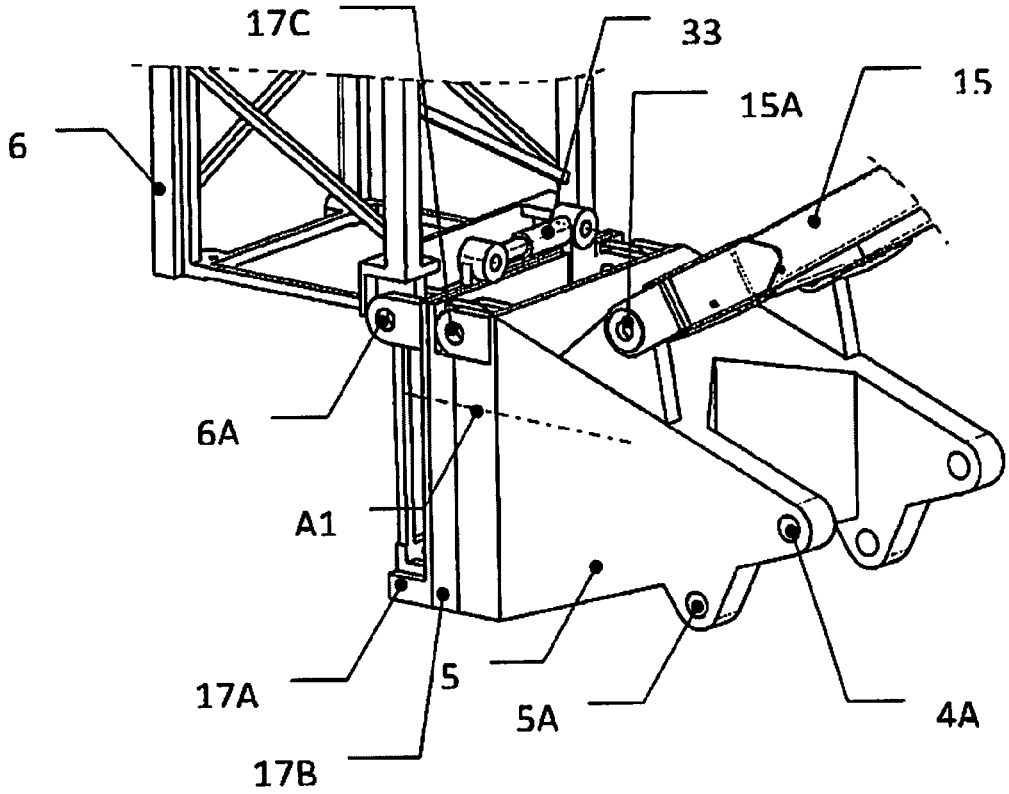
FIG. 11*e* shows a variant to the solutions shown in the other FIG. 11.

In another variant, shown in FIG. 11*e*, rotating part 17*a* of joint 17 can be motorized with respect to the fixed one 17b, through the intermediation of a motorized element 33 (linear actuator, motor, reduction gear, preferably of hydraulic type) which permits to orientate around axis A1, the tilt (α angle) of arm 6 which moves integrally with rotating part 17*a*. When used as machine 1, this motor element would be then locked for making rigidly fixed the relative position of parts 17*a* and 17*b* such that arm 4, in the group of its component elements (5, 17, 6, 7, 21, 9) behaves as a monolithic object.

In FIGS. 11, 11*a-d* it can be observed in detail how joint 17 can be realized, that is with a fixed part 17*b*, integral with base 5 of the arm, disengageable in rotation around axis A1, with respect to a rotating part 17*a* of the same joint, which is fixed to lower arm 6. Fixed part 17*b* of the joint is mounted on base 5 through fastening systems of movable type such for instance: pins on hinges 17*c* and screw fastening means 35.

Advantageously, the fastening interface (hinge 17*c* with screws 35, only pins or only screws) between base 5 and fixed part 17*b* is the same which is present between rotating part 17*a*, arm 6 and foot 18, in such a way so that joint 17 in its whole, if demounted, can permit the direct fastening between base 5 and the lower part of arm 6 for the crane application shown in FIG. 2. Fixed part 17*b* of the joint is centrally characterized by a surface of cylindrical guide whose axis is substantially coincident with the axis A1. Rotating part 17*a* of the joint couples with the rotating part of the guide and is axially locked by mechanical striking elements 31, shown in figure as lunettes, which are fixed with screws 36 to fixed part 17*b*. In this way part 17*a* is free to rotate around A1, guided by fixed part 17*b*. The cylindrical guide among the elements in relative rotation can be realized with steel-to-steel contact or with bushings or bearings; the essential characteristic is that it keeps free the rotation around axis A1. A part of joint 17 will be then fixed to the base of arm 5, whereas a front part of the joint can rotate around axis A1. Furthermore, it is to be considered as equivalent the solution in which the fixed body of guide 17*b* is external and rotating body 17*a* is internally positioned with reference to the position of the cylindrical guide.

In FIGS. 11 and 11*b* are also shown fastening pins 34 which lock rotating part 17*a* and fixed part 17*b* of joint 17, when it remains mounted on arm 4 also in crane version (in this case the joint must be rigidly fixed because it is not allowed any torsion tilt of the arm). Rotating part 17*a* of joint 17 bears hinge 6A which disengages arm 6 around axis 6A when arm 4 is to be lifted or tilted.

Rotating part 17*a* of joint 17 bears also the additional striking and fastening elements (not shown in figure, but of the type previously described, with pins or screws) for foot 18 used in the drilling machine version.

Figure 12:
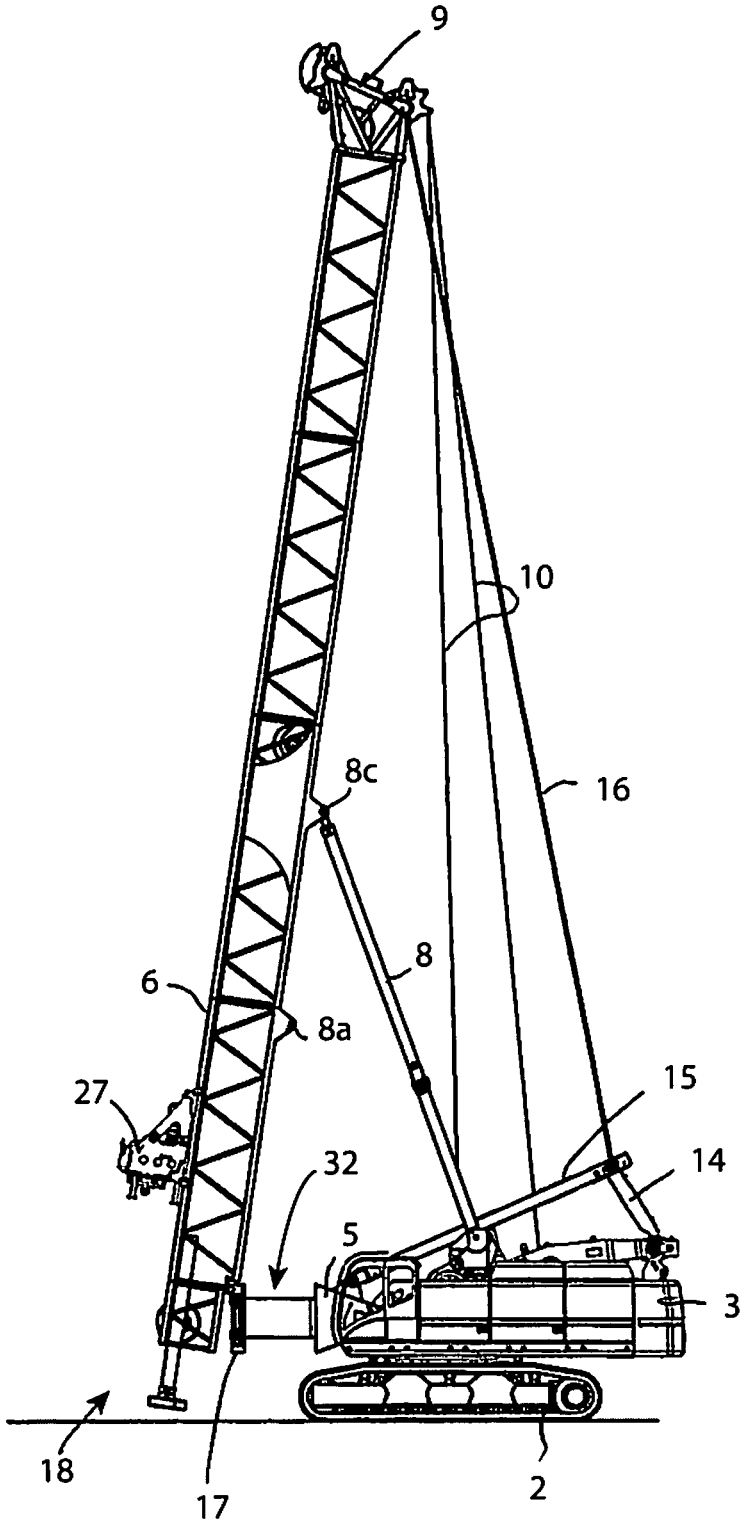
FIG. 12 shows the machine in a constructive variant.

FIG. 12 shows a detail of the base of the arm realized with telescopic extension 32 for allowing the spacing out of the lower part of the arm used as guide from the machine and the drilling with higher tilts.

This variant can be realized by including a preferably hydraulic telescopic element which is connected between the base of arm 5 and joint 17, or which is directly connected to the frame of turret 3 in correspondence with fastening points 4A and 5A, replacing the base of arm 5 or finally which is connected between the frame and the base of the arm and letting the whole base 5 and joint 17 integral with it translating.

One base of the machine with an opportunely modified and extensible arm can be assembled with simplicity as crane or drilling machine increasing the usage flexibility according to the specific construction site.

The machine can be assembled with variable and flexible lengths of the arm in such a way as to vary the heights of the lifting in the crane version and the performances as drilling machine, adapting it to the various needs of the construction sites, for instance a short arm for works in lowered environments (overbridges or bridges) or a long arm configuration for increasing the excavation depths in only one movement.

Figure 1:
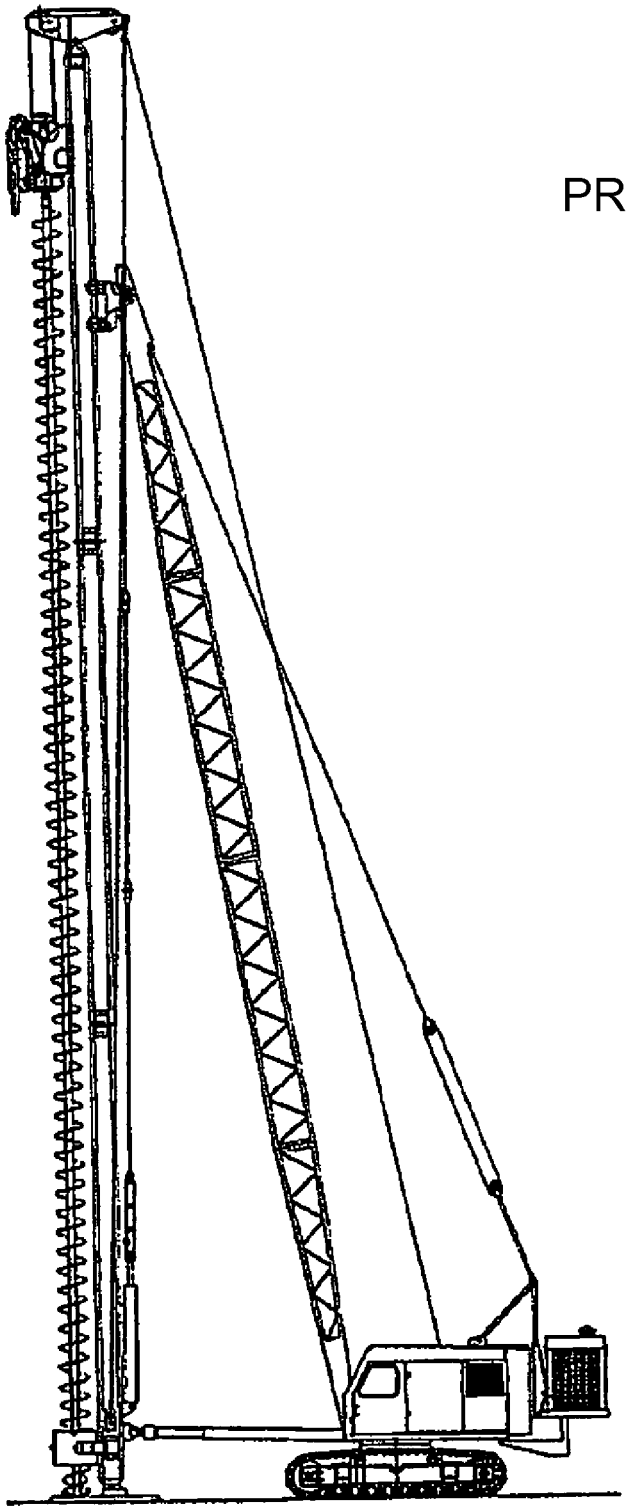
PRIOR ART Fig. 1
FIG. 1 is the lateral view of a known machine for drilling of the tracked crane type with additional tower.

The machine in drilling assembling can be provided with a traction-thrust system with winch, increasing the number of possible transformations for the different drilling technologies. This winch, joint 17 and other dedicated parts of the version suitable for drilling, can be left installed on the arm for avoiding mounting and demounting, to advantage of the simplicity and the reduction of the times required in the transformations. With respect to the known technologies of FIG. 1, wherein the road transport needs different transport means, the base machine of the machine object of this invention requires only one, whereas the other components which concur in completing the machine can be transported with ordinary means.

The operating capacities of the machine used in the drilling machine version are increased with respect to what is possible to do nowadays using the known solutions. The possibility of using the arm of the crane as drilling guide reduces the front weights and the crane is more stable. Furthermore, the excavation axis is much reduced if compared to the known version with the additional tower. This involves an increase of the excavation depths being equal the operating load or with a reduction of the masses (requiring lower rear ballasts of load balancing) to advantage of the maneuverability and the reduction of the working encumbrances of the machine. The variant with the telescopic element positioned in proximity of the base arm permits to increase the working radii and to work anyway with even relevant working tilts.

By using the arm as guide, the solution allows for savings, not being necessary to have an additional drilling tower.

Finally, in a first aspect of the invention, it is provided a machine comprising a tracked lorry which supports a turret containing the propeller group (which could be also separated and external in some applications which require a high power) and the driving cab, to which it is connected an arm, generally of lattice tower type, with the possibility of being used in an assembling configuration, as a lifting arm for the function as crane and in a second configuration, as sliding guide for the drilling devices. Thanks to the double usage of the arm, it is possible to reduce the big-sized components which compose the machine significantly reducing the mounting/demounting/transforming times.

A second aspect of the invention is the modular composition of the lattice tower arm/guide with the possibility of being installed in various lengths, for increasing the usage flexibility of the machine.

In the condition of drilling machine (see for instance FIG. 3) it is shown a condition wherein arm 4 is forwarded with respect to machine 1*a* and lies on the ground. It can be assumed, however, that arm 4 could be also positioned on the machine frontally with respect to turret 3 or above it, still in forwarded position.

As a matter of fact, it aims only to opportunely size the machine and the turret, but no conceptual variant is necessary to the rotation devices of arm 4 for bringing it into the vertical position in front of or above the turret.

The invention claimed is:

1. Multi-function machine for drilling, boring, driving and lifting comprising a tracked lorry which supports a rotating turret motorized and provided with a driving cab; a lattice tower arm is directly hinged to a frame of the turret movable between a substantially raised position and a tilted position on a front for angles between a nearly vertical direction and a nearly horizontal direction for use in at least a first configuration as lifting arm;

the arm comprising a base and a lower part;

a free upper end of the arm has a head having a system of pulleys or transmissions for at least a maneuvering rope; the arm rotating with respect to the turret to acquire a second configuration of mounting and transport wherein a longitudinal axis of the arm is substantially horizontally arranged and turned over toward the front; means for bringing the arm between said first to said second configuration and vice-versa; wherein the arm can acquire a third operating configuration wherein the longitudinal axis of the arm is substantially vertically arranged;

wherein in said third configuration the arm comprises guiding elements integral with the arm for digging and drilling means sliding in a direction substantially parallel to the longitudinal axis of the arm; actuating means for maneuvering the arm at least in said third configuration;

wherein in said third configuration, elements of the arm are rigidly connected and directly fixed to the turret with a system of pins on hinges to prevent movement and to keep a longitudinal axis of the base of the arm in a substantially horizontal position;

wherein the arm mounts to the frame of the turret by the base of the arm on first hinge means around a first axis substantially orthogonal to the longitudinal axis of the arm, and is mounted, in correspondence with a lower part, to the base on second hinge means about a second rotation axis, substantially parallel to the first axis, adapted to permit the arm to acquire a deviation from the third configuration in which verticality of the arm is correctable;

wherein the arm is constrained to the frame of the turret around said first rotation axis for acquiring said first configuration as a lifting arm for the functioning of the machine as a crane, and around said second rotation axis for acquiring said third configuration as a sliding guide for the drilling devices.

2. Machine according to claim 1, wherein the arm is at least temporarily disengageable from the frame in rotation around a third axis having a direction orthogonal to said first and second rotation axis of the arm.

3. Machine according to claim 1, wherein, in at least an operating configuration, on the arm is installed a joint upon which rotates the arm around the third axis for acquiring a lateral tilt and around the second axis for acquiring a lifted or lowered tilt.

4. Machine according to claim 3 wherein the joint is subdivided into two parts, including a rotating part and a fixed part, guided by a cylindrical rotating surface and axially blocked by a mechanical striker.

5. Machine according to claim 4 further comprising a locking device of the two parts of the joint.

6. Machine according to claim 3 wherein the joint is motorized and the actuator is hydraulic.

7. Machine according to claim 3, wherein the joint is movable via a motorized telescopic element interposed between the arm and the frame of the turret.

8. Machine according to claim 1, wherein the first hinge means permit the arm to acquire a frontally inclined configuration.

9. Machine according to claim 1, wherein the arm is of modular type for being set up for various lengths.

10. Machine according to claim 1 further comprising a fixing device installable in at least one of the operating configurations, for locking the arm rigidly with respect to the frame of the turret, by connecting the arm to a point not coincident with the axis.

11. Machine according to claim 1, wherein the base of the arm comprises a telescopic extension.

* * * * *